US006808439B2

(12) United States Patent
Carpenter

(10) Patent No.: US 6,808,439 B2
(45) Date of Patent: Oct. 26, 2004

(54) VIBRATORY FINISHER WITH BLASTING NOZZLE

(75) Inventor: Steven J. Carpenter, East Jordan, MI (US)

(73) Assignee: Roto-Finish Company, Inc., Kalamazoo, MI (US)

( * ) Notice: Subject to any disclaimer, the term of this patent is extended or adjusted under 35 U.S.C. 154(b) by 0 days.

(21) Appl. No.: 10/053,236

(22) Filed: Nov. 9, 2001

(65) Prior Publication Data

US 2003/0186626 A1 Oct. 2, 2003

Related U.S. Application Data

(63) Continuation-in-part of application No. 09/732,794, filed on Dec. 8, 2000, now abandoned.

(60) Provisional application No. 60/211,641, filed on Jun. 14, 2000.

(51) Int. Cl.[7] ..... B24B 1/00

(52) U.S. Cl. ..... 451/34; 451/35; 451/38; 451/326

(58) Field of Search ..... 451/2, 38, 39, 451/40, 32, 34, 35, 85, 90, 326, 327, 328

(56) References Cited

U.S. PATENT DOCUMENTS

| | | | |
|---|---|---|---|
| 2,996,846 | A | 8/1961 | Leliaert |
| 3,008,274 | A | 11/1961 | Welter |
| 3,071,900 | A | 1/1963 | Balz |
| 3,161,997 | A | 12/1964 | Balz |
| 3,214,871 | A | 11/1965 | Olson et al. |
| 3,411,248 | A | 11/1968 | Dwyer et al. |
| 3,432,968 | A | 3/1969 | Croft et al. |
| 3,527,000 | A | 9/1970 | Carter |
| 3,603,036 | A | 9/1971 | Reed et al. |
| 3,793,780 | A | 2/1974 | Musschoot |
| 3,924,357 | A | 12/1975 | Schmidt et al. |
| 4,115,960 | A | 9/1978 | Zecher |
| 4,257,196 | A | 3/1981 | Walther et al. |
| RE30,977 | E | 6/1982 | Zecher |
| 4,693,037 | A | 9/1987 | McNeil |
| 5,460,566 | A | 10/1995 | Trahan |
| 5,476,415 | A | 12/1995 | Nishimura et al. |
| 5,556,320 | A | 9/1996 | Baker |
| 5,637,029 | A | 6/1997 | Lehane |
| 5,733,172 | A | 3/1998 | Nishimura et al. |
| 6,210,258 | B1 | 4/2001 | Malkin et al. |
| 6,231,426 | B1 | 5/2001 | Liao |

FOREIGN PATENT DOCUMENTS

| | | |
|---|---|---|
| DE | 28 31 688 | 2/1980 |
| DE | 28 55 962 | 7/1980 |
| DE | 38 11 680 | 12/1988 |
| EP | 0 289 845 | 11/1988 |
| EP | 0 636 456 | 2/1995 |
| FR | 2 445 735 | 8/1980 |

*Primary Examiner*—Eileen P. Morgan
(74) *Attorney, Agent, or Firm*—Flynn, Thiel, Boutell & Tanis, P.C.

(57) ABSTRACT

A process and apparatus wherein a bulk quantity of parts is positioned in a channel-like treating chamber which is subjected to vibration to cause the flowable mass of parts to slowly undergo a corkscrew-like tumbling movement. One or more nozzle arrangements are positioned adjacent the treating chamber so that each nozzle has its discharge orifice position closely adjacent the flowing bulk mass in the chamber to effect high-velocity blasting of a selected region of the flowing mass. The nozzle emits a high-velocity spray which is defined by a carrier medium such as air having small abrasive particles or grit embedded therein. The abrasive spray contacts a concentrated area which has relatively small transverse and longitudinal extent over the flowing mass in the chamber. Due to its high-velocity discharge, the spray is effective in penetrating at least partway into the depth of the flowing mass to abrade the parts.

18 Claims, 9 Drawing Sheets

Vibratory/Blast System

VIBRATORY FINISHER WITH BLASTING NOZZLE

CROSS-REFERENCE TO RELATED APPLICATION

This is a continuation-in-part of application Ser. No. 09/732,794 filed Dec. 8, 2000, now abandoned, which application claims priority under 35 U.S.C. §119(e) of copending provisional application Ser. No. 60/211,641, filed Jun. 14, 2000, the entire disclosure of which is herein incorporated by reference.

FIELD OF THE INVENTION

This invention relates to an improved process and apparatus for finishing, and more specifically abrading, a large number of parts, substantially in bulk treatment, for removing flash, burrs, sharp corners and surface contamination.

BACKGROUND OF THE INVENTION

A wide variety of vibratory and tumbling processes and apparatus have been developed for finishing parts, and these known arrangements for the most part are reasonably efficient in their performance on some parts, particularly larger and more durable parts. The known arrangements, however, have proven less effective when dealing with large quantities of smaller parts and specifically those of more delicate materials such as plastics or powdered metals, and in particular those parts having complex configurations.

One of the most commonly used techniques for finishing parts involves a tumbling device such as an elongate barrel which rotates or moves generally about a horizontal axis, and the bulk quantity of parts is positioned in the barrel whereby they travel upwardly along one interior side of the barrel during rotation thereof, and then tumble back downwardly due to the effect of gravity. Tumblers of this type may be of a batch-type construction having a tumbling chamber in which a batch of parts is deposited, or may be of a flow-through construction having a generally spirally-shaped guide channel generated about the rotational axis so that the parts progressively move from an inlet end to an outlet end of the tumbler but the parts are otherwise treated in the same manner as in a batch-type tumbler. Many of these tumblers also use nozzles disposed interiorly thereof to effect blasting of the parts simultaneously with the tumbling thereof. These known arrangements, however, have been observed to be relatively violent in that the nature of the tumbling action makes it difficult to control the movement of the parts, and thus such arrangements have been observed to cause significant damage such as chipping and the like when the parts being processed are of a fragile or delicate nature. Such tumblers also are normally incapable of providing desired control over part movement since the nature of the overall movement of the bulk mass causes some parts to violently tumble downwardly along the top of the mass, whereas other parts slide backward at the bottom of the mass and hence are not properly exposed to the blasting spray.

Similar known tumbling devices involve angled moving belts which cause the bulk mass to move in a manner similar to a rotating barrel device and hence possess similar limitations.

With respect to known vibratory arrangements, the parts are typically positioned in a vibratory machine having an elongate and typically annular channel which contains not only the parts, but also a quantity of bulk abrasive media together with water or other liquid. Due to the vibration of the machine, the parts and bulk abrasive media function effectively as a flowable mass such that the parts and abrasive media are moved, typically in a progressive screw-like pattern along the length of the confining chamber as a result of the vibration of the apparatus. The gradual tumbling movement of the flowable mass causes the parts and abrasive media to continually rub and contact one another so as to effect surface finishing of the parts. While such vibratory arrangement is particularly desirable in that it is capable of handling and not severely damaging delicate parts, nevertheless such process is relatively slow in terms of performance time, is typically a wet process which requires additional secondary operations such as drying, and also requires substantial quantities of consumable abrasive media. This arrangement also is not as effective for finishing of complex shaped parts, specifically those having bores or holes therethrough due to the difficulty in effectively accessing such regions during tumbling of the flowable mass.

When utilizing tumblers for effecting blasting of parts as briefly described above, typical operation of the process normally results in overblasting of the batch of parts in order to effect blasting of all parts in the batch, which overblasting is required due to the nonuniformity of the blasting process and which results in some parts being excessively treated. This also results in the overall blasting process being of reduced efficiency due to the extended blasting time involved and the greater use requirements of abrasives.

With many prior processes and apparatus, particularly when surface finishing parts having complex contours and/or internal cavities, it has been necessary to physically individually fixture the parts in order to permit the parts to be acted on by appropriate tooling or blasting nozzles so as to permit surface treating of the complex part surfaces and specifically the interior cavity walls. The need to individually fixture and treat parts is obviously a very inefficient and time consuming process, but is a process which is frequently resorted to in view of the inability to effectively surface treat such parts using other known techniques.

Accordingly, it is an object of this invention to provide an improved process and apparatus for finishing, for example abrading, parts which particularly have a complex configuration or shape, and/or which may be of delicate or frangible material, with the improved process and apparatus of this invention overcoming many of the disadvantages associated with prior arrangements.

It is a further object of the invention to provide an improved process for finishing bulk parts by a continuous process which enables the parts to slowly move, as with a tumbling movement along a spiral path having closely adjacent convolutions, through a treating zone created by a blasting nozzle to permit a first-in first-out operation.

It is a still further object to provide a process, as aforesaid, which utilizes a vibratory device containing a narrow but elongate treating channel combined with a blasting nozzle which sprays, at high velocity, a preferably dry abrasive spray into the moving bulk mass in the channel to effect surface treating of the moving tumbling parts as they move through the spray zone.

More specifically, this invention relates to a process and apparatus wherein a bulk quantity of parts are positioned in a channel-like treating chamber which is subjected to vibration so as to cause the flowable mass of parts in the chamber to slowly undergo a corkscrew-like tumbling movement, whereby the parts are slowly and gently circumferentially tumbled around the transverse cross-section of the treating chamber while at the same time the flowable mass of parts is progressively moved lengthwise of the chamber. In a preferred embodiment, one or more nozzle arrangements are positioned directly over the treating chamber so that each nozzle has its discharge orifice position closely adjacent and directly above the flowing bulk mass in the chamber so as to effect a high-pressure blasting of a selected region of the flowing mass. The nozzle emits a downwardly-directed high-velocity spray which is defined by a carrier medium such as air having small abrasive particles or grit embedded therein. The abrasive spray contacts a reasonably small or concentrated area which has relatively small transverse and longitudinal extent over the flowing mass in the chamber. Due to its high-velocity discharge, the spray is effective in penetrating downwardly at least partway into the depth of the flowing mass. Accordingly, the slow corkscrew-like vibratory movement of the tumbling bulk mass causes and allows the orientation of the individual parts making up the mass to constantly change as they slowly move through the relatively small blasting zone defined below the nozzle, whereby the many different surfaces including edges and corners of the parts are thus subjected to the high-velocity abrasive spray which is effective for removing flash, burrs, sharp edges, surface oxides and the like.

In the improved process and apparatus of the present invention, as aforesaid, the blasting nozzle typically involves use of air as a media for effecting high-velocity discharge of solid abrasive media, and the velocity of the discharge from the blasting nozzle will normally be in the range of from about 80 to about 150 feet per second so as to achieve the desired abrading performance. In some instances, however, the carrier media for the abrasive as discharged from the blasting nozzle may comprise a liquid.

In the improved apparatus and process of this invention, as aforesaid, the vibrating apparatus includes an elongate treating channel which typically is circular or arcuate and is subject to vibration in a conventional manner so as to effect gradual and gentle corkscrew-like tumbling of the flowable mass in the lengthwise extent of the channel, and in many instances a plurality of blasting nozzles are positioned in longitudinally spaced relationship along and typically above the channel to permit subsequent treating of the flowable mass as it slowly tumbles and longitudinally advances along the channel. The sequentially positioned blasting nozzles can themselves be utilized to supply different types of blasting media so as to permit the flowable mass to be progressively abraded using different blasting media, such as finer or softer media as the flowable mass approaches its discharge time or location.

With the improved process and apparatus of the present invention, by causing the abrasive media to be blasted into the slowly tumbling bulk mass of parts which slowly move into and through a small and concentrated blasting zone, the use of carrier media such as air or water as well as the higher pressure thereof necessary to effect high discharge velocity, and the quantity of solid abrasive media which is intermixed in the discharged spray, can be optimized in terms of both efficient use and overall performance, and at the same time the tumbling of the mass of bulk parts is sufficiently gentle as to minimize damage to the parts as a result of both the tumbling and blasting thereof.

In the improved process and apparatus of the present invention, the blasting nozzle may be positioned at various locations relative to the elongate treating channel so as to optimize the overall treating effect. For example, while positioning the blasting nozzle above the channel will normally be a preferred location, nevertheless in some situations the nozzle may be disposed so as to discharge directly into the flowable mass within the channel, such as by disposing the nozzle so that it is oriented to discharge directly through the wall of the channel, such as through a side or bottom wall of the channel. In addition, the blasting nozzle may utilize any conventional technique for introducing the abrasive into the discharged fluid stream, such as either a conventional vacuum or aspiration-type nozzle which effectively sucks the abrasive into the fluid stream, or a conventional pressure-type nozzle which effectively causes the abrasive under pressure to be injected into the discharged fluid stream. In addition, in some applications the overall finishing performance may be vastly improved by intermixing the bulk parts with a plurality of inert flowable tumbling elements such as polyurethane elements which are relatively inert when subjected to the abrasive media discharged by the blasting nozzle, whereby the flowable mass defined by the inert tumbling elements and the parts being treated thus provides increased or optimized spacing and tumbling of the parts and hence increased treating thereof by the abrasive media as the parts flow through the blasting zones.

Other objects and purposes of the present invention will be apparent to persons familiar with processes and arrangements of this general type upon reading the following specification and inspecting the accompanying drawings.

Figure 1:
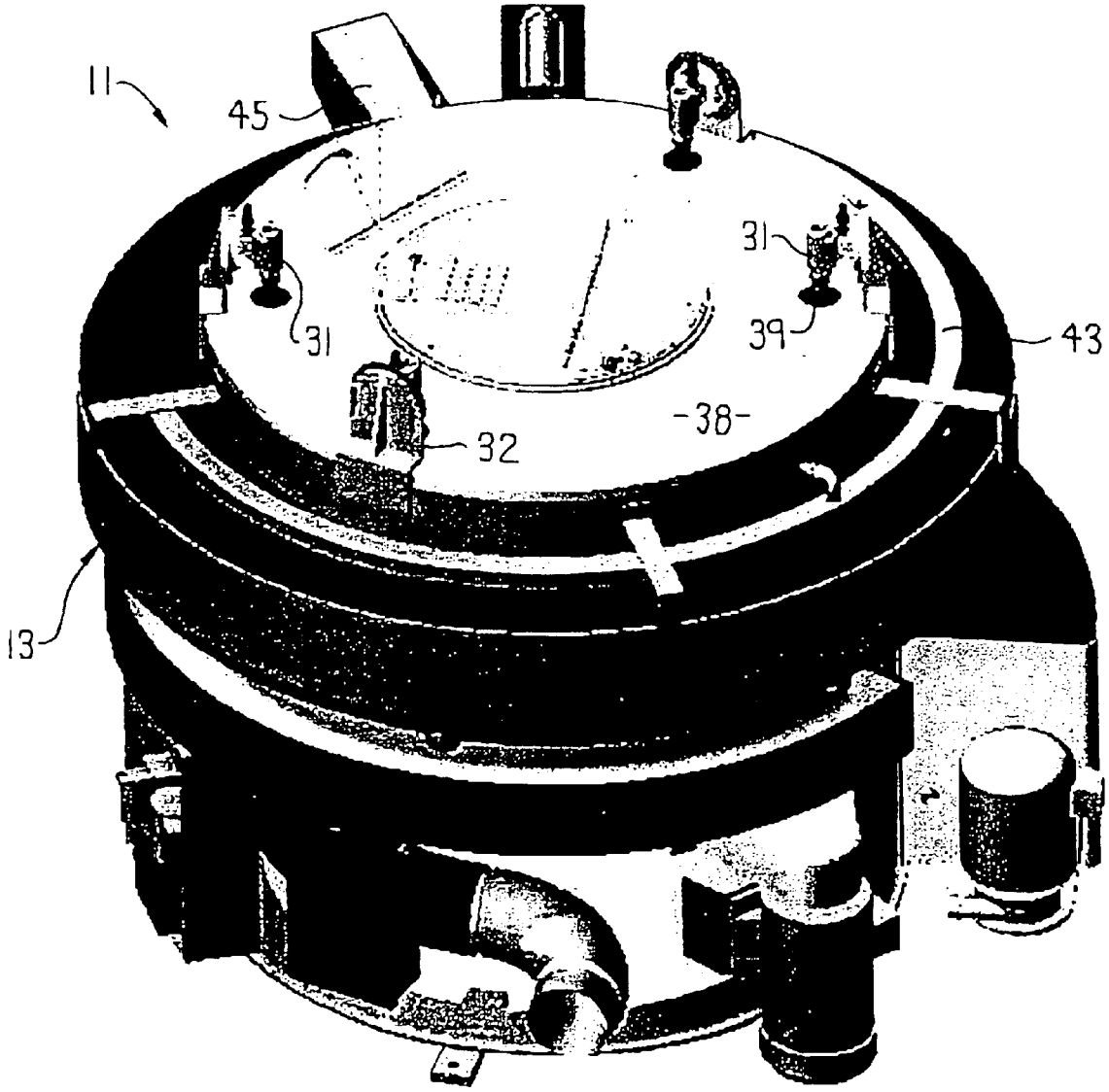
FIG. 1 is a perspective view of a vibratory finishing apparatus for a flowable bulk mass and having, in the illustrated arrangement, a plurality of blasting nozzles associated with the apparatus and positioned above the treating channel for effecting abrading of the mass of parts in the treating channel.

Certain terminology will be used in the following description for convenience and reference only, and will not be limiting. For example, the words "upwardly", "downwardly", "leftwardly" and "rightwardly" will refer to directions in the drawings to which reference is made. The word "forward" will also refer to the normal advancing direction of the flowing mass along the treatment channel. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Referring to FIGS. 1–6, there is illustrated an improved finishing apparatus 11 for carrying out the improved finishing process of the present invention, which finishing of parts involves abrading of the parts to effect removal of flash, burrs, sharp corners and undesired surface features such as oxides.

The apparatus 11 includes a generally upright housing 12 which, in the illustrated embodiment, is constructed generally as an upright cylinder and includes an upwardly-opening tub 13 fixed thereto in surrounding relationship therewith. The tub 13, in the illustrated embodiment, includes annular channels 14 and 15 which extend generally concentrically of the tub in surrounding relationship to one another and open upwardly, whereby these channels accommodate therein a flowable bulk mass for effecting treating thereof as described hereinafter.

The housing 12 is supported on a generally rigid frame 16 by a plurality of springs 17 which have lower ends mounted to the frame and upper ends mounted to the housing, with the plurality of springs being disposed in circumferentially spaced relationship around the central axis 22 of the housing so as to resiliently support the housing for vibratory movement generally about this axis.

The housing 12 mounts thereon a vibratory device for effecting vibratory or gyratory movement of the housing due to its support by the springs 17. The vibratory device includes a motor 18 which is mounted on the housing and acts through a drive arrangement, specifically a belt drive 19, for effecting rotation of a shaft 21 which is rotatably supported on the housing 12 generally along the central axis 22 thereof. The rotary shaft 21 in turn mounts thereon an eccentric weight arrangement 23 which, when rotated, effects a vibratory or gyratory movement of the entire housing 12 relative to the frame 16.

The channel 15 is elongated generally along a longitudinally extending central axis 25, with this channel and its axis in the illustrated embodiment being of a generally annular or circular configuration generated substantially about the central axis 22 of the housing. It will be appreciated, however, that the elongate channel 15 can be of an arcuate configuration which is other than circular, for example it can be spiral relative to the central axis, and in some situations the channel can be defined in a vibrator which is of a straight configuration, such being well known.

The channel 15 typically has a top or mouth 26 which is open so as to allow access into the channel, with the channel itself being defined by a surface wall 27 which along at least the bottom portion of the channel preferably has a rounded concave configuration which typically resembles a semicircle, and in the illustrated and preferred embodiment the channel 15 has a transverse cross section whereby the substantially rounded bottom wall joins to side walls which project upwardly and continue with the same curvature as the bottom wall so that a majority of the side wall of the channel is defined by a generally circular configuration which extends through an angle in excess of 180°, for example an angle of about 210° up to about 240°, with this rounded side wall configuration then joining to side wall portions which project upwardly and define the mouth of the channel. This configuration of the channel cross section, which itself is well known, facilitate the desired transverse rotary tumbling of the parts when the apparatus is vibrated, as discussed hereinafter.

The side wall 25 which defines the channel area, and hence functions as a liner for the channel so as to provide protective contact with the parts being moved along the channel, is typically constructed of a molded plastics material such as polyurethane or equivalent.

The overall construction of the apparatus 11 as described above is conventional and well known, and in effect constitutes a structure which is provided in vibratory tub or bowl-type part finishing devices.

The apparatus 11 of the present invention mounts thereon at least one blasting nozzle arrangement 31 which, in this embodiment, is disposed directly above the treating channel 15. The blasting nozzle arrangement 31 in the illustrated embodiment is secured to a mounting bracket 32 which in turn connects to a wall of the housing 12 which extends in surrounding relationship to the channel 15. The nozzle arrangement 31 is oriented generally vertically so that its discharge end or orifice 33 is disposed generally at or within the upwardly opening mouth of the channel 15, and the discharge orifice is oriented generally downwardly into the channel 15 so as to emit a generally conical spray pattern 36 onto the flowing bulk mass 37 which is disposed within and is being tumblingly advanced longitudinally along the channel. The blasting nozzle arrangement has appropriate conduits 34 and 35 connected to the body thereof so that one supplies high-pressure blasting fluid to the nozzle, and the other supplies relatively fine particulate solid abrasive (i.e. grit). The very fine or small-sized abrasive particles as supplied to the nozzle may be contained in a liquid carrier if desired, such as a slurry, so as to facilitate supply of grit to the nozzle since any liquid associated with the slurry will be readily atomized in the nozzle.

The nozzle arrangement 31 is of conventional construction in that it utilizes the high pressure of the blasting fluid and, in passing through the nozzle body to the discharge opening, effects entrainment therein of the particulate blasting media, whereupon the nozzle orifice 33 thus effects downward discharge of the spray 36 which conventionally has an enlarging conical spray pattern as it moves away from the discharge orifice. The discharge spray 36 is defined by the main blasting fluid which is discharged from the nozzle 33 at a high velocity and which has entrained therein the small solid particles defining the abrasive media.

In a preferred arrangement the blasting fluid comprises air, although other gases such as nitrogen could be used. It will be recognized that in some situations liquids such as water may be utilized as the blasting fluid. The fluid (i.e. air) discharged from nozzle 33 preferably will typically be discharged at a velocity in the range of from about 60 feet per second to about 280 feet per second, with the typical and normal discharge velocity range expected to be between about 80 feet per second and about 150 feet per second.

Figure 5:
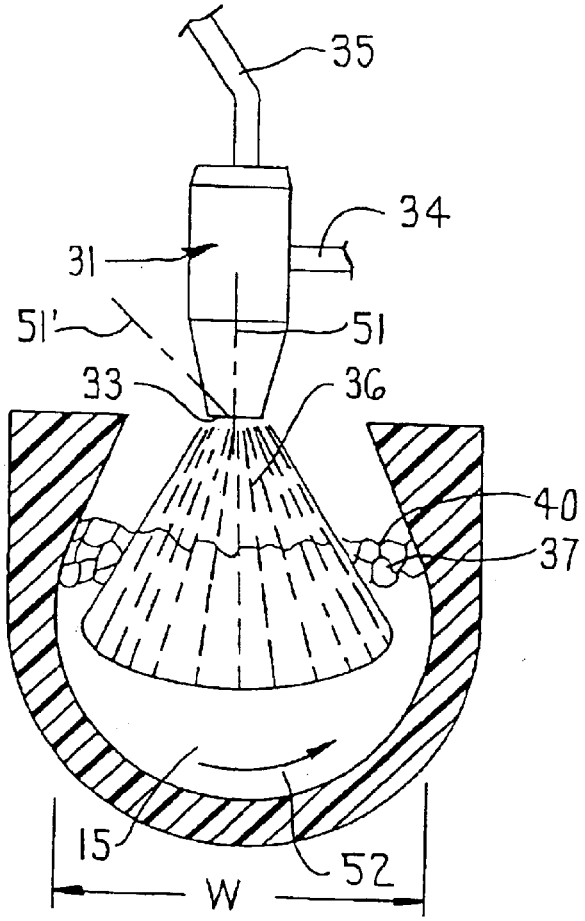
FIG. 5 is an enlargement of solely the treating channel and its associated blasting nozzle, and a diagrammatic representation of the penetration of the blasting spray into the flowing mass of bulk parts.

As illustrated by FIG. 5, the flowing bulk mass 37 typically comprises a large quantity of small elements or parts which occupy a significant portion of the channel 15, such as at least the lower part of the channel so that the flowing mass has an upper surface level which, as indicated at 40, is generally positioned close to but spaced downwardly a small distance below the discharge orifice 33 of the blasting nozzle. This relationship, coupled with the high velocity of the conical discharge 36 and the looseness or porosity of the bulk mass 37, causes the discharge spray 36 where it contacts the flowing mass 37 to be concentrated over a rather small area which extends both transversely and longitudinally of the flowing mass, but at the same time this enables the discharged spray 36 to penetrate downwardly into the flowable mass at least a significant distance toward the bottom of the channel. The individual members or parts of the flowing mass, as they move through the blasting region (i.e. volume) which is contacted and penetrated by the discharge spray 36, thus are intimately acted upon by the high-velocity carrier containing abrasive media therein so as to effect desired abrading of the parts so as to remove burrs, flash, sharp corners and the like without effecting any significant damage to the parts.

In the illustrated arrangement the housing 12 is provided with a top cover 38 which effectively encloses the top 26 of the treating channel 15, and this cover 38 has a small opening 39 therein through which the discharge end of the nozzle arrangement 31 projects for access with the channel 15. The cover 38 thus provides for desired confinement of the discharge spray 36 interiorly of the treating channel.

The top cover 38 in turn is provided with an openable gate or hatch 41 which permits the bulk quantity of parts to be deposited into the channel 15 for subsequent abrading or treating thereof. This can be accomplished manually if desired, or alternatively the hatch or gate 41 can be controlled automatically and connected to a suitable supply chute.

The arrangement 11 is also provided with a gate 42 which controls communication from the treating channel 15 to the outer channel 14. The gate 42 is of conventional construction and controlled by a driving device such as a pressure cylinder (not shown) so that when the gate 42 is closed the channel 15 is a continuous annular track which enables the parts to be moved therearound through multiple revolutions. Opening of this gate 42, however, diverts the parts from the channel 15 into the outer channel 14 which can be provided with appropriate nozzles or other supply devices 43 for supplying cleaning fluid or the like to the channel 14 to effect removal of abrasives and other undesirable contaminants from the parts. A deflector 44 at the end of channel 15 causes the finished parts to be deflected sidewardly to a discharge chute 45. The channel 15 will have suitable filters, screens and the like associated therewith for effecting removal of the fluids, and abrasive solids and other contaminants can be separated from the finished parts in a conventional manner.

In operation of the apparatus 11, the vibratory or gyratory movement of the tub 13 causes the bulk part mass 37 to undergo a gentle rotary tumbling movement in a direction which is generally transverse to the lengthwise extent of the channel 15, which transverse tumbling is significantly aided by the partial rounded cross section of the channel. Simultaneous with this transverse rotary tumbling of the parts, the flowable mass 37 is also slowly advanced in the lengthwise or longitudinal direction of the channel. The flowing mass 37 hence has a gentle tumbling movement which has a configuration which roughly corresponds to a helical or corkscrew-like movement, such being diagrammatically indicated at 46 in FIG. 6. With this arrangement, movement of the flowing bulk mass along the elongate treating channel 15 hence causes the individual parts which make up the flowable bulk mass to be tumbled in a generally circular pattern transversely of the track through numerous revolutions or convolutions 50 simultaneous with the longitudinal advancement of the mass, and hence longitudinal advancement of the individual parts, in the lengthwise extent of the track. As the gently and slowly tumbling bulk mass 36 moves into and thence through the spray zone defined below the blasting nozzle arrangement 31, the individual parts hence are undergoing a transverse rotary tumbling movement simultaneous with a slow longitudinal advancing movement through the spray zone, and in doing so the parts are undergoing a constantly changing orientation as they move through the blasting zone, thereby providing exposure of substantially all of the part surfaces to the blasting zone as the parts tumble slowly therethrough.

Figure 6:
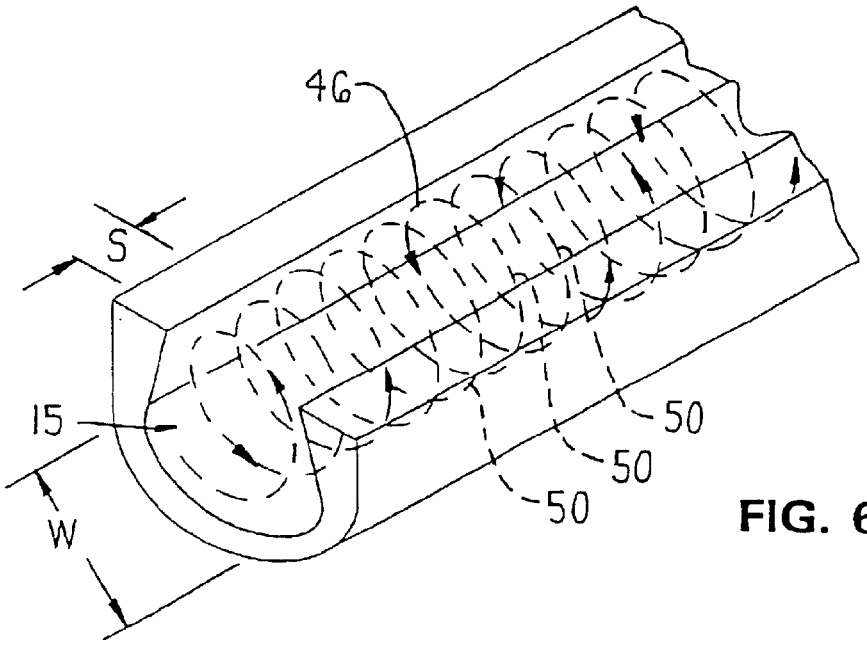
FIG. 6 is a diagrammatic perspective representation as to the tumbling corkscrew-like movement of the flowing mass of parts longitudinally along the treating channel.

In the process and apparatus of this invention, the treating channel is preferably of narrow width, which width in the cross section illustrated in FIG. 5 occurs at the diameter of the rounded bottom wall as indicated at W. This narrow width is preferably in the range of about four inches to about eight inches, although in some situations may be as large as about twelve inches. This small width and the preferred use of the substantially semi-circular rounded bottom wall of the channel hence permits the bulk mass as it flows with a spiral or corkscrew-like tumbling motion along the channel to generate a large number of transverse convolutions or loops 50 which are positioned in closely adjacent relationship lengthwise of the channel. That is, the "lead" S (i.e., the forward advance per convolution, or the spacing between the centers of adjacent convolutions) of the corkscrew-like motion is small. As illustrated in FIG. 6, the lead S is significantly smaller than the width W of the channel 15. This causes increased part-to-part contact within the flowing mass and, more significantly, increases the exposure of the parts to the blasting spray as the mass moves through the blasting zone, as discussed below.

The narrow width of the channel also enables the blasting spray to be positioned close to the upper surface of the flowing mass (i.e., preferably within about two to about four inches) while at the same time allowing the spray pattern where it contacts the flowing mass to preferably extend across at least a majority of the width thereof, as shown in FIG. 5, with the spray contacting the mass over a similar distance in the lengthwise direction of the channel. At the same time, the high velocity of the discharged spray enables it to penetrate downwardly into the porous flowing mass through a significant extent, thereby concentrating the energy of the abrasive spray over a small volume within the flowing mass so that the abrasive particles are able to rebound or bounce off the parts and the channel wall so as to increase the abrasive activity within the flowing mass.

The narrow width of the channel further provides control over the depth of the flowing bulk mass while providing the desired tumbling movement of the mass to occur across the width of the channel. More specifically, the mass will normally have a depth no greater than the channel width, and preferably a depth less than the channel width but greater than one-half the channel width, particularly for a part-on-part flowing mass. This thus permits the proper tumbling movement as the mass moves along a spiral path, and at the same time permits the spray at the spray zone to penetrate downwardly at adequate extent into the mass so as to effect the desired surface finishing of the tumbling parts.

In addition, these relations coupling with the vibration imposed on the device provides the corkscrew motion with a lead S (i.e., lengthwise advancement per convolution)

which is less than the lengthwise extent of the spray zone, with the lead preferably providing one, as a minimum, to about one and one-half convolutions 50 of the flowing mass being exposed to the blasting spray within the blasting zone. This hence ensures that substantially all parts pass into and through the spray zone during a single passage of the mass through the spray zone. This is particularly desirable to permit a substantially continuous treating process and specifically a first-in first-out process.

This process is also highly desirable for surface treating parts with openings therethrough or cavities therein since the high energy abrasive spray and its application to the tumbling parts, and the significant rebound energy of the abrasive within the flowing mass, enables the abrasive to enter into and act against the opening or cavity walls and at the same time the tumbling movement of the parts ensures that the abrasive is dumped or discharged from the openings or cavities.

Figure 2:
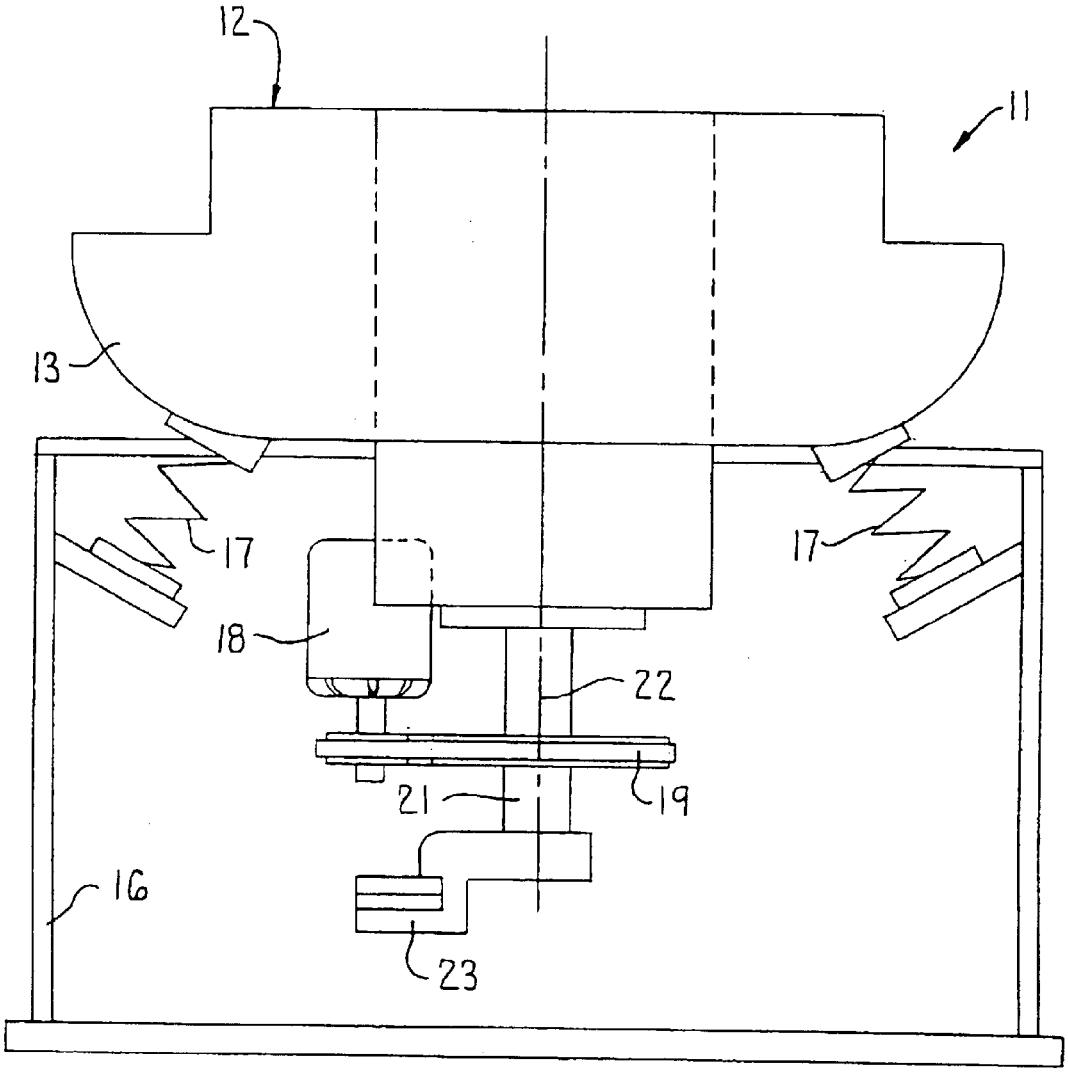
FIG. 2 is a fragmentary side elevational view which diagrammatically illustrates the arrangement of FIG. 1.
Figure 3:
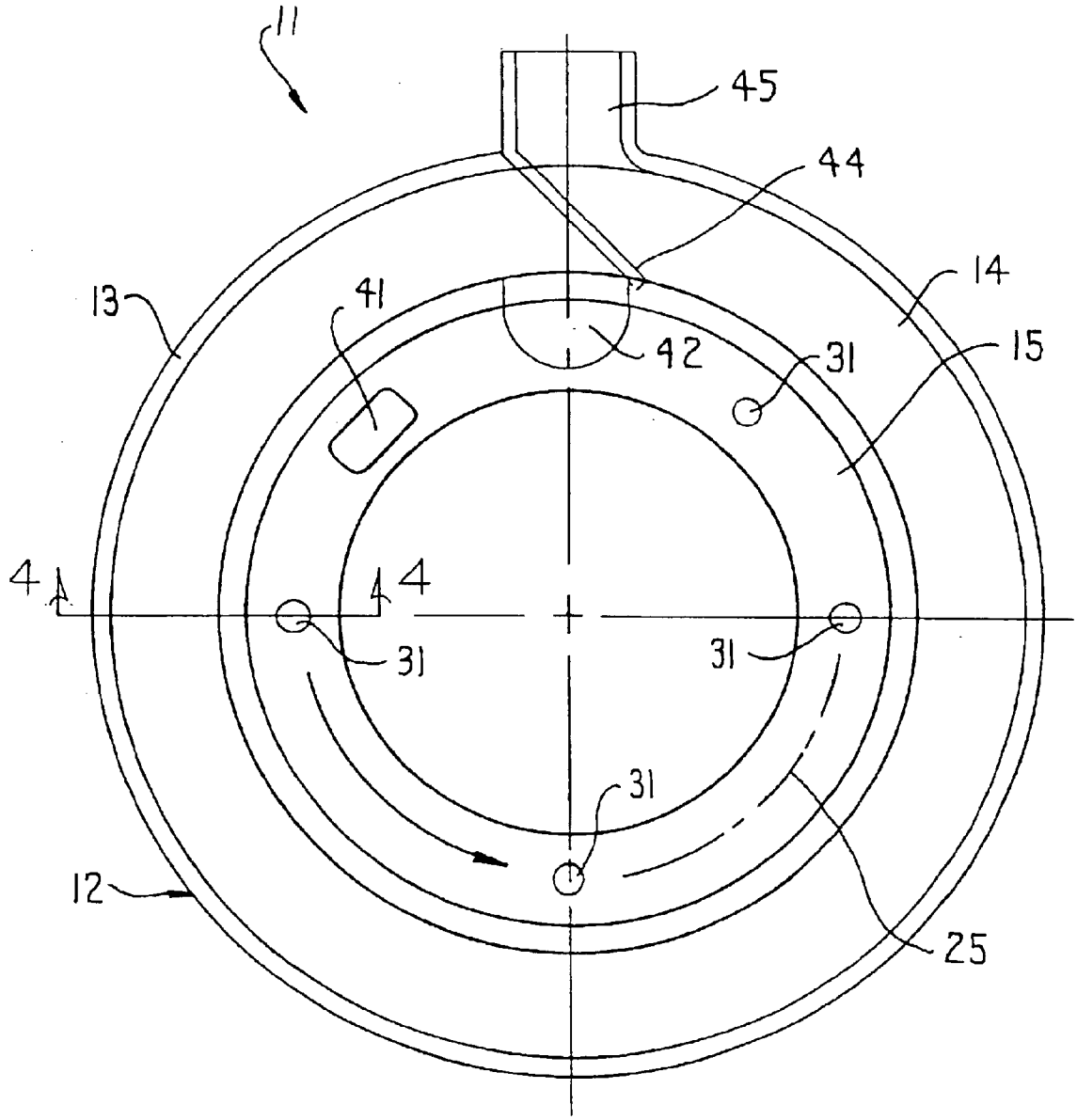
FIG. 3 is a top view of the apparatus wherein the cover over the treating channel has been removed for clarity of illustration.
Figure 4:
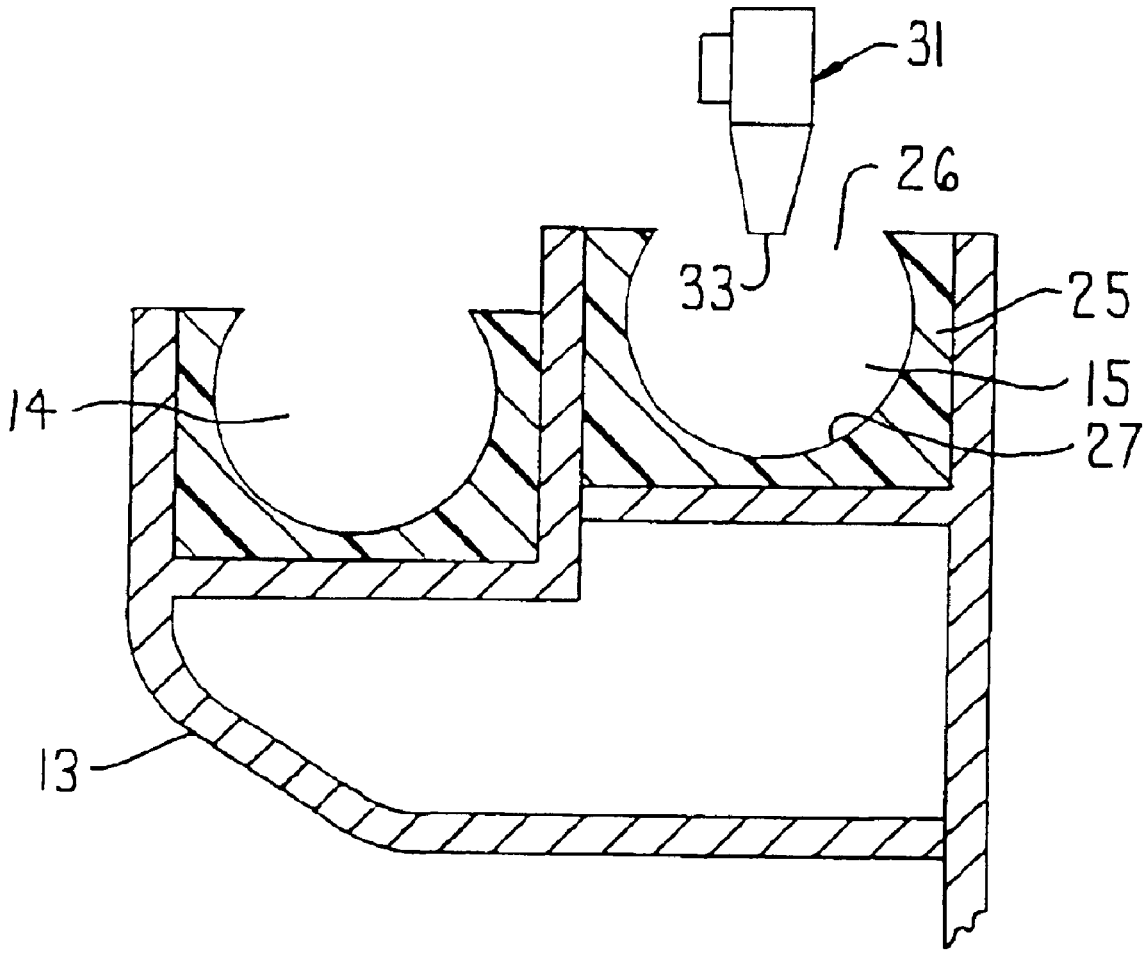
FIG. 4 is an enlarged fragmentary sectional view which illustrates the cross section of the treating channel and the disposition of a blasting nozzle thereover.

With the arrangement of the present invention, the treating channel can be provided with multiple blasting nozzles associated therewith at spaced intervals therealong, such being illustrated by FIG. 2 which depicts four such blasting nozzles disposed in spaced relationship along the treating channel. When using multiple blasting nozzles, this permits the overall abrading process to be finely tuned since each blasting nozzle can be utilized to provide its own unique blasting characteristic. For example, the different blasting nozzles can be provided with different blasting pressures, and/or different blasting media in terms of either material properties and/or particle size, so as to permit subsequent and optimized abrading of the parts defining the flowable bulk mass. More specifically, a first blasting nozzle as disposed more closely adjacent the upstream end of the channel may be provided so as to supply a first type of abrasive media entrained within the carrier fluid discharged into the flowing mass of parts, which first abrasive may be of a larger size or coarseness, or of a harder material, so as to effect initial abrading and finishing of the parts since at this stage the parts are in a rougher or more unfinished condition. At a second or subsequent blasting nozzle disposed downstream from the first nozzle, the second nozzle can be utilized to discharge a second abrasive media which is different from the first media, which second media may be of less coarseness or smaller size and/or of less hardness so as to effect a more refined or less severe abrading of the parts as they approach the desired finished surface condition. If desired, a third subsequent blasting nozzle can be positioned downstream of the second nozzle and can be used to discharge a third different abrasive media into the flowing mass of parts, with this third abrasive providing a finer finishing of the parts such as effecting a final abrading or cleaning of the parts, so that the parts when discharged from the treating apparatus have been appropriately abraded and cleaned by being subjected to multiple sequential treating steps which progressively refine the treated surfaces so as to achieve the desired end result. This arrangement is highly suitable and desirable for a continuous process which enables the flowing bulk mass to be treated on a first-in first-out basis whereby large quantities of parts can be efficiently processed.

In addition, after the flowable bulk mass has passed beneath at least a first blasting nozzle, the abrasive media from the blasting spray remains within the flowable bulk mass, and thus this abrasive media continues to tumble with the bulk mass and continues to effect continued abrasive action on the parts being finished.

While in many use situations the flowable bulk mass will initially be defined solely by a plurality of small parts, such as small molded or formed plastic or powdered metal parts, nevertheless in some situations it may be desirable to define the flowable mass by mixing the parts, particularly large parts, with a particulate inert carrier, such as plastic particles or the like, so as to provide for desired carrying and spacing of the parts as they are tumbled along the track 15 and specifically as they are tumbled into and through the spray zone. Any such particulate inert carrier will obviously be selected so as to avoid damage to the parts. As an example, the particulate inert carrier may comprise discrete tumbling elements formed from an inert material which is not severely affected by the abrasive media discharged from the blasting nozzles, such as forming the inert tumbling elements from urethane. Such urethane tumbling elements will be shaped and sized so that they do not effectively interlock with either themselves or the parts being treated, and yet the tumbling elements will maintain the parts in the flowing mass in more widely spaced relationship while at the same time providing the desired rolling and tumbling movement of the parts and in fact the different shape of the tumbling elements relative to the parts may increase or provide for a different mode of tumbling movement of the parts, so as to enhance the overall finishing or treating of the parts during their exposure to the abrasive media as the parts move through the blasting zones which are defined in the flowing mass adjacent the discharge from the blasting nozzles.

While FIG. 5 illustrates the blasting nozzle disposed so that the direction of discharge (discharge axis 51 in FIG. 5) is oriented substantially perpendicular to the upper surface level 40 of the flowing bulk mass 37, it will be appreciated that desired or optimum performance may be achieved by orienting blasting nozzle 31 so that the blasting direction or axis is oriented at an angle relative to the perpendicular or vertical direction, which angle may be as much as 45° relative to the vertical, and can be angled sidewardly (i.e. transversely) in either direction relative to the vertical, or can be angled forwardly or rearwardly relative to the vertical (i.e., angled forwardly or rearwardly relative to the advancing direction of the mass longitudinally along the channel). In some situations the discharge of the spray 36 may be oriented so that the discharge is angled sidewardly so as to be directed directly into and hence opposed to the circular tumbling direction of the flowing mass. As illustrated in FIG. 5, if the flowing mass is undergoing a circular tumbling movement in the direction depicted by the arrow 52, then the discharge axis of the nozzle may be angled sidewardly so as to be disposed approximately as indicated by the line 51' in FIG. 5 so that the discharged spray is thus oriented more directly in opposition to the direction of tumbling of the parts as they move upwardly along the side wall of the channel and approach the surface 40 of the flowing mass.

It will also be appreciated that the tip or discharge end of the nozzle 31 as illustrated in FIG. 5 can also be disposed at varying distances above the surface 40, and in fact the discharge nozzle can be moved vertically downwardly relative to the flowing mass 37 so that the discharge tip of the nozzle is positioned closely adjacent the upper surface of the mass. Under such situation, a much more intense spraying of adhesive over a smaller discharge zone will occur, although such is also regulatable by means of the pressure of the carrier fluid being supplied to and discharged from the nozzle.

Figure 7:
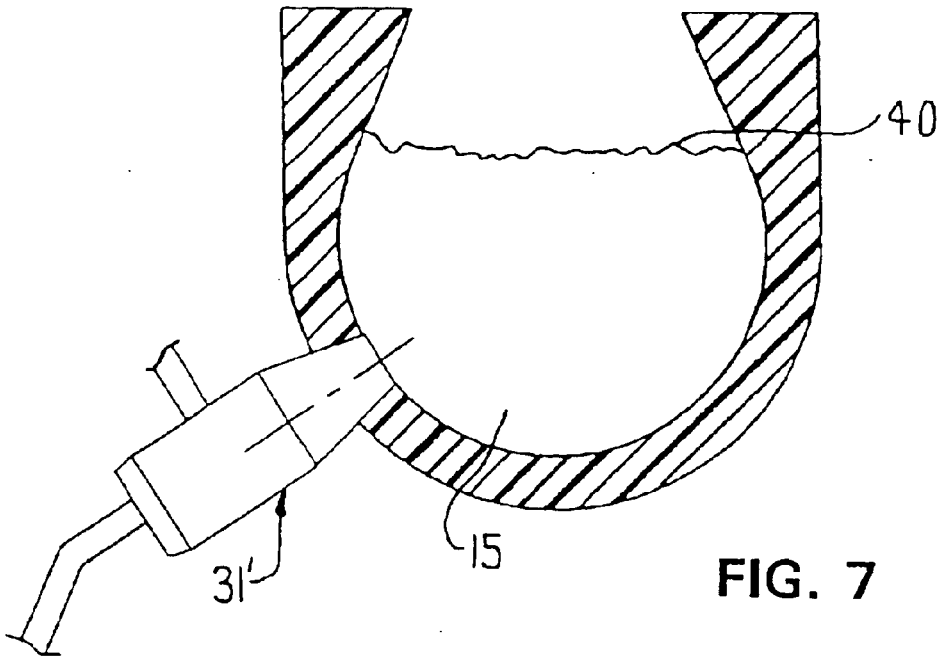
FIG. 7 is a diagrammatic representation similar to FIG. 5 but illustrating a modification wherein the blasting nozzle communicates directly with the flowing mass and acts through the side wall of the treating channel.

Referring now to FIG. 7, there is illustrated a variation of the invention wherein, in contrast to FIG. 5, the blasting nozzle in the FIG. 7 embodiment is disposed so that the nozzle discharge tip is associated with a side wall of the treating channel so as to effect discharge of the abrasive-carrying spray directly into the flowing mass. With this arrangement one or more blasting nozzles can again be disposed for disposition at longitudinally spaced intervals along the treating channel so as to permit the tumbling mass to pass progressively through several blasting zones. The mounting of the nozzles so that they are oriented through the channel sidewall hence provides greater flexibility with respect to the structure associated with the upper side of the channel in terms of enclosures and the like and, at the same time, this arrangement of FIG. 7 permits the abrasive-carrying spray as discharged from the nozzle to act more intensively directly on the tumbling flowing mass to effect the desired abrading and treating of the parts. The nozzle when so disposed can again be oriented so that the angularity thereof relative to the channel wall and relative to the flowing mass is selected so as to optimize performance. Further, when using multiple blasting nozzles associated with the side wall of a channel, the nozzles can be positioned so as to be all associated with one side wall of the channel, or different nozzles can be associated with opposite side walls of the channel so as to further optimize the desired treating process. As a still further alternative, some nozzles can be provided on either one or both side walls of the channel, and other nozzles can be positioned above the channel in the manner illustrated by FIG. 5.

Figure 8:
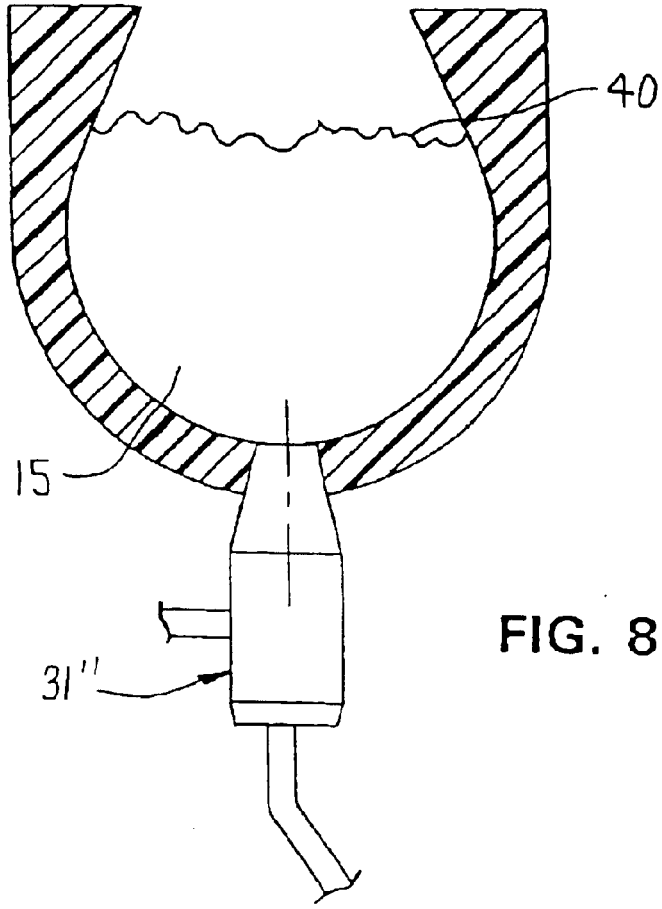
FIG. 8 is a diagrammatic representation similar to FIG. 7 but illustrating a further variation wherein the blasting nozzle acts through the bottom of the channel so as to discharge the abrasive spray upwardly into the flowing mass.

As a still further variation, one or more of the nozzles can, as illustrated in FIG. 8, be disposed so that the nozzle is associated with the bottom of the channel wall so that the abrasive-carrying spray is directed upwardly into the tumbling flowing mass. The blasting nozzle illustrated by FIG. 8 can again be angularly oriented relative to the flowing mass so as to optimize performance, and the generally upwardly oriented discharge of the abrasive-carrying spray is believed particularly desirable for permitting treating of the parts adjacent the bottom of the treating channel in a manner which is generally opposed to the effects of gravity, so that the discharged spray hence tends to effect lifting and hence increases the tumbling and overall random agitation of the parts as they move through the blasting zone created by the upwardly-directed spray. The arrangement of FIG. 8 can, of course, be combined with additional blasting nozzles oriented in manners similar to those illustrated by FIGS. 5 and 7.

In carrying out the improved treating process of the present invention, it will be recognized that a wide range of particulate abrasive may be utilized for discharge from the blasting nozzles, with the nature of the abrasive being selected according to the finishing treatment desired. For example, if the abrasive constitutes rigid metal grit or equivalent or small metal shot, then the pressure of the carrier fluid as supplied to the nozzle and the discharge velocity from the nozzle will necessarily be higher. If the abrasive from the blasting nozzle is of a softer material such as for effecting fine finishing or cleaning, such as walnut shells, then the pressure of the carrier fluid supplied to the nozzle will be significantly less, and likewise the discharge of the abrasive spray from the nozzle will also typically be of lower velocity.

Figure 10:
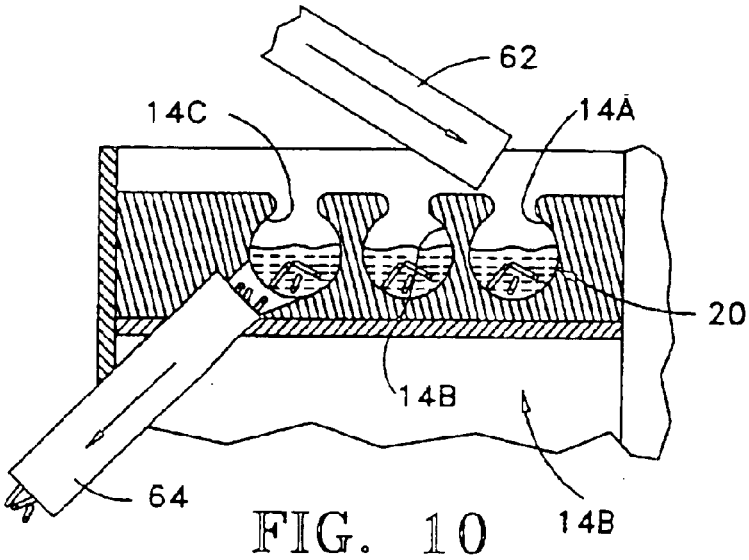
FIG. 10 is an enlarged fragmentary cross sectional view of the apparatus of FIG. 9.
Figure 9:
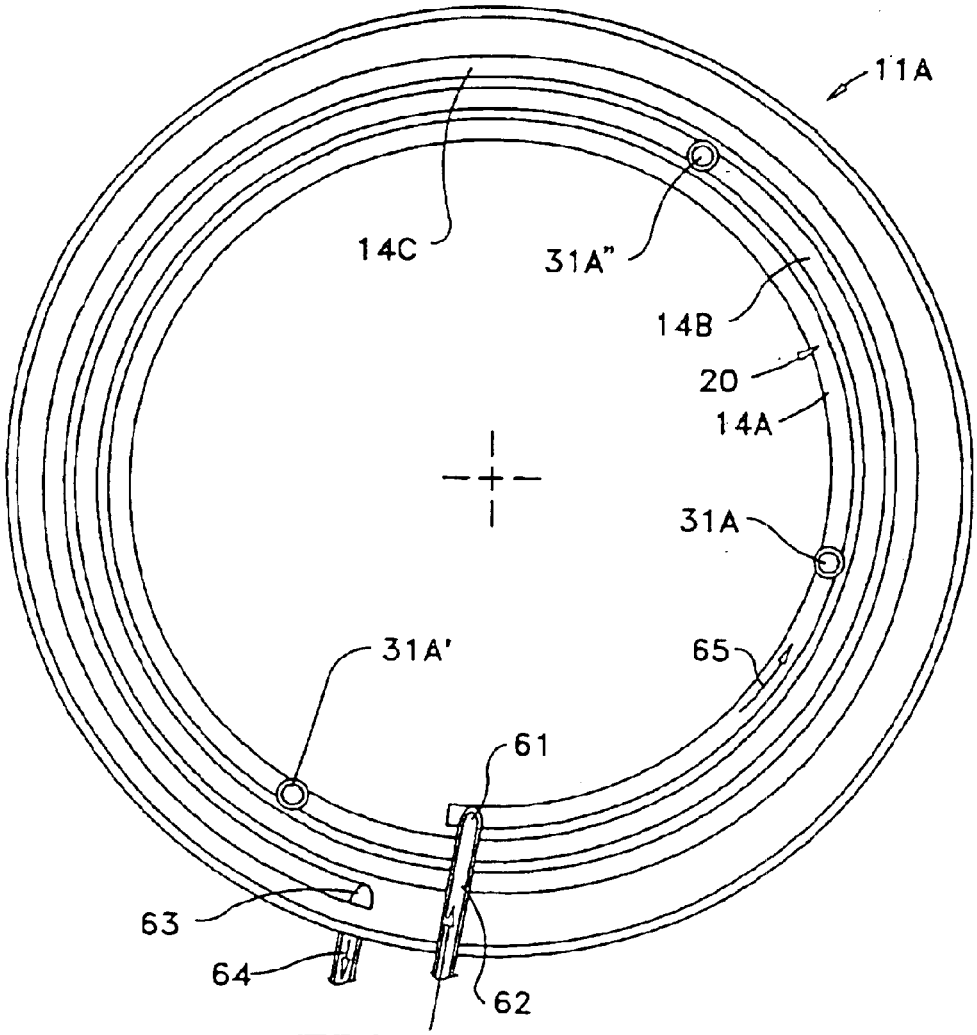
FIG. 9 is a plan view of an alternate apparatus having a treating channel defined by annular parts which surround one another in lengthwise communication.
Figure 11:
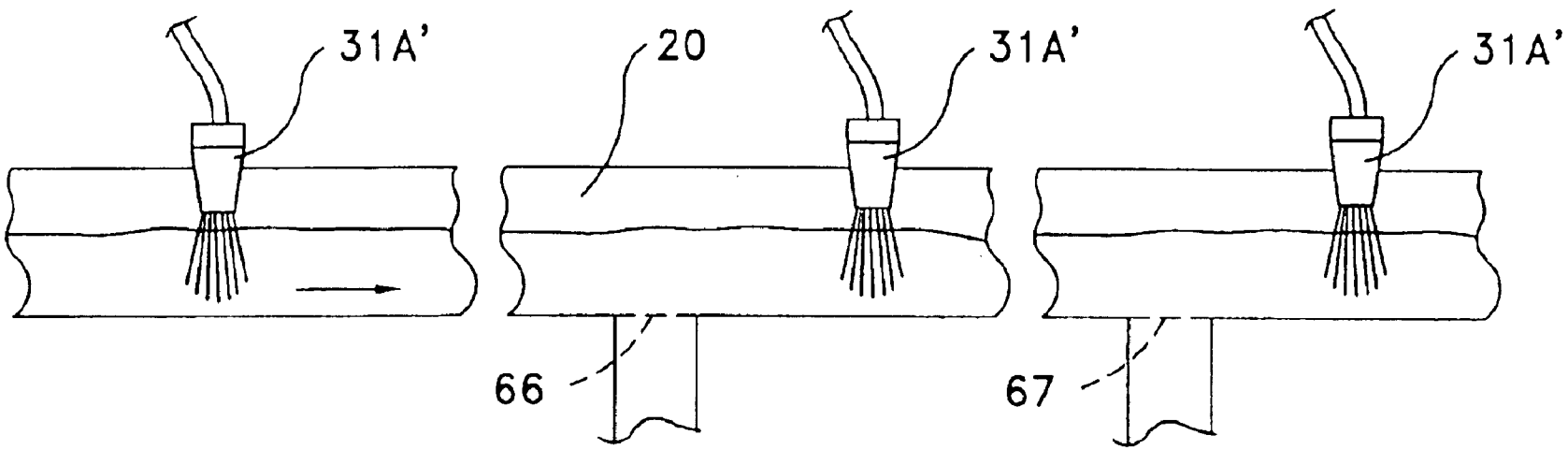
FIG. 11 is a diagrammatic illustration of the treating channel in the lengthwise extent thereof.
Figure 12:
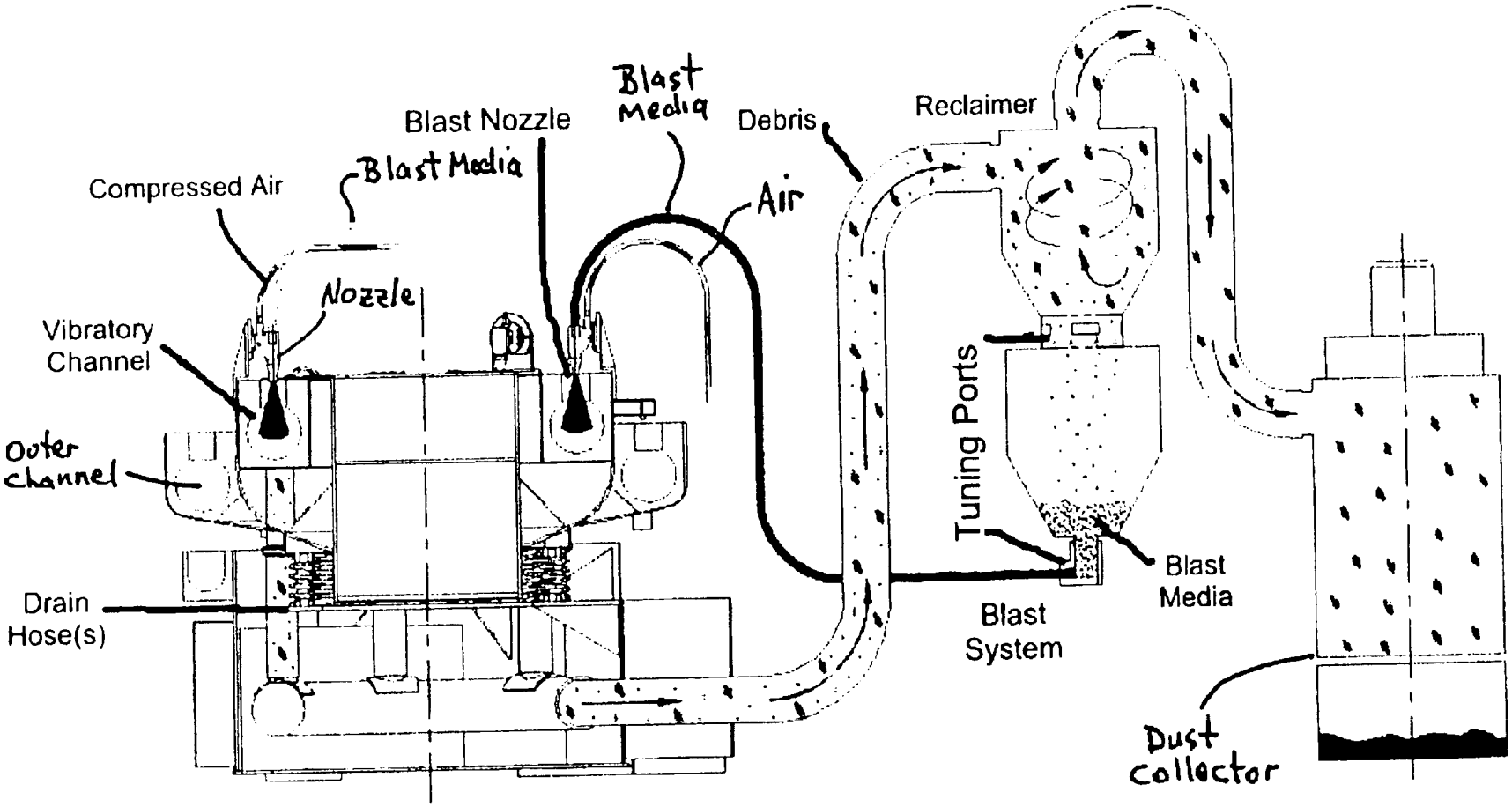
FIG. 12 diagrammatically illustrates the operation of the vibratory blast system of this invention.

Referring now to FIGS. 9–11, there is illustrated a variation of a vibratory finishing apparatus for flowable bulk mass according to the present invention wherein the apparatus has a generally continuous and substantially horizontally elongate treating channel formed generally as a spiral so as to define multiple annular loop parts which effectively encircle one another but which greatly facilitates a continuous first-in first-out treating of flowable bulk parts by permitting the parts to be moved sequentially through several treating locations which are disposed lengthwise along the treating channel. The parts of the apparatus shown in FIGS. 9–11 which correspond to parts of the apparatus of FIGS. 1–5 are designated with the same reference numerals but with addition of an "A" thereto.

In the vibratory apparatus 11A, the upwardly-opening tub 13A defines therein an elongate treating channel 20 which is generally formed concentrically about the vertical center axis of the tub, with the treating channel 20 having a generally horizontally elongated but spiral configuration so as to be defined by a plurality of generally annular channel parts which substantially encircle one another. In the illustrated embodiment, the spiral treating channel 20 is illustrated as having three encircling annular channel parts which, for purposes of identification are designated as 14A, 14B and 14C. These latter channel parts all effectively connect in open communication with one another as the treating channel 20 spirals outwardly around the central axis of the tub.

The channel 20 again has a rather small cross section, namely a small width and depth, with the width typically being in the range of about four inches to about six inches, and the bottom of the channel having a rounded concave wall in cross section which preferably approximates a semicircle so that, during the vibration of the apparatus, the loose parts associated with the flowing bulk mass within the channel readily undergo the desired tumbling movement as the mass undergoes a corkscrew-like motion lengthwise of the channel in the downstream direction thereof, with the adjacent convolutions of the corkscrew motion being closely adjacent to thereby provide for desired control and yet tumbling agitation of the parts, particularly as the flowing mass passes through spray zones associated with the channel, as described hereinafter.

With the apparatus illustrated by FIGS. 9–11, the flowable bulk mass can be supplied to the channel 20 at an inlet or supply point 61 which is preferably disposed adjacent the radially inner end of the spirally-configured channel 20, which flowable mass can be supplied to the input location 61 as associated with the inner channel part 14A via any suitable supply arrangement such as a trough or channel 62. The treating channel 20, preferably adjacent the radially outer end thereof, is similarly provided with a discharge or output location 63 which, in the illustrated embodiment, is disposed adjacent the downstream end of the outer annular channel part 14C. This discharge location 63 can in turn communicate with any suitable discharge arrangement such as a trough or passage 64 so as to permit the flowing bulk mass to be discharged from the channel 20 after a one-time passage of the mass through the channel.

The apparatus 11A, in accordance with the present invention, is provided with one or more blasting nozzle arrangements associated with the channel 20 so as to permit treating of the bulk mass within the channel as it flows downstream from the inlet location 62 to the discharge location 63. Each blasting nozzle arrangement, three such arrangements being illustrated and designated 31A, 31A' and 31A", can preferably be disposed so that the discharge orifice of the nozzle is positioned generally at or within the mouth of the channel 20 so that the discharge orifice is positioned closely adjacent and directly over the upper surface of the tumbling flowing mass similar to the arrangement illustrated in FIG. 5 as described above so as to create a downwardly directed spray zone which is defined by preferably high-velocity air having entrained small solid abrasive particles therein so that the blasting spray intimately contacts the flowing mass over an upper surface area which has similar proportions in the widthwise and lengthwise directions of the channel, and which spray is also effective with respect to penetrating downwardly through the porous flowing tumbling mass through a significant extent. This spray zone and the associated configuration of the channel 20 and the slow spiral-like tumbling path of the parts, which spiral tumbling path has the lead or displacement between adjacent convolutions of the path equal to and preferably less than the lengthwise width of the blasting spray zone, hence ensures that substantially the entirety of the parts carried in the flowing bulk mass are thus subjected to and treated by the high velocity blasting spray as the continuous flowing mass moves into, through and thence out of the spray zone in response to vibration of the treating channel. The parts thus effectively all pass into and through the spray zone at least once during the substantially continuous downstream movement of the flowing mass from the inlet of the channel to the outlet thereof.

Preferably several such spray nozzles are disposed at spaced locations in the downstream direction of the channel to permit several sequential spraying operations to be carried out with respect to the flowable mass which moves continuously in the downstream direction of the channel. The various nozzles can be used to spray similar abrasives or, alternatively, can be used to spray different abrasives or treating compounds so as to provide for refined surface finishing and abrading of the parts as they move downstream throughout the finishing channel. For example, the abrasive associated with the spray at the nozzle 31A' may be somewhat smaller and/or of less hardness than the abrasive utilized at the upstream nozzle 31A to provide for a higher degree of smoother surface finish, and in similar fashion the downstream nozzle 31A" may be utilized to blast even finer and/or softer abrasive so that the parts passing thereunder achieve an even more desirable surface finish. It will be appreciated that the number of blasting nozzles positioned along the channel, and the types of abrasive supplied to and discharged from the different blasting nozzles, can be selected in accordance with the nature of the parts being treated and the degree or nature of the surface finish desired.

With this modified arrangement, the flowable bulk mass which may consist solely of parts to be finished, or a mixture of parts and inert tumbling elements, can be supplied in a generally continuous manner into and through the supply trough 62 for deposit into the vibrating tub 13A at the input end 62 of the channel 20. The vibration of the channel causes the flowable bulk mass to undergo a slow tumbling movement along a spiral or corkscrew path lengthwise or downstream of the channel, as indicated by arrow 65. During this downstream tumbling movement the flowing mass will sequentially pass through the spray zones defined under each of the blasting nozzles 31A, 31A' and 31A", with the closeness of the adjacent tumbling convolutions being typically spaced apart by a distance less than the lengthwise extent of the spray zone so that all of the rotating tumbling parts associated with the mass are rotated upwardly into the upper extremity as the mass passes through the spray zone so as to ensure that substantially all parts within the mass are hence subjected to the abrasive spray and hence are effectively surface treated. This same action occurs as the flowing tumbling mass moves slowly and progressively downstream through each of the spray zones. As the mass is moving along the channel between spray zones, the abrasive which was sprayed into the mass at the upstream spray zone remains intermixed with the mass and tumbles with and hence abrasively acts on the surfaces of the tumbling parts. Under normal circumstances, however, the abrasive supplied by one upstream nozzle will, if different from the abrasive at the next downstream nozzle, be removed from the channel prior to the flowing mass moving into and through the spray zone associated with the next downstream nozzle. For example, as diagrammatically illustrated in FIG. 11, the abrasive sprayed into the mass at the upstream nozzle 31A can be removed from the mass at a downstream location which, in the illustrated arrangement is disposed just upstream of the next nozzle 31A', with the abrasive from nozzle 31A being discharged through a suitable perforated screen 66 associated with the bottom of the channel 14A. The abrasive supplied through the next nozzle 31A' can similarly be discharged through a further discharge screen 67 which is disposed just upstream of the next downstream nozzle 31A". This hence permits more efficient separation and reuse of abrasives and more effective surface treating of the parts.

After the flowing mass is moved through all of the spray zones and reaches the discharge location 63 defined at the downstream end of the channel 20, which is also the outermost extremity of the spirally configured channel 20, the mass is effectively continuously discharged into a discharge chute 64 from which the mass can then be furthered handled as desired. The abrasive supplied to the mass at the various spray zones can be maintained in the mass and discharged therewith for subsequent separation or, if desired, the channel can be provided with screened discharge openings at selected locations along the bottom of the channel so as to permit at least a significant part of the abrasive to be separated from the flowing mass prior to reaching the discharge location 63.

With the present invention, it will be further appreciated that the first-in first-out continuous processing of parts can also be utilized in a generally continuous manner so as to permit treating of sequential batches of similar of dissimilar parts. For example, several batches of similar or dissimilar parts can be generally continuously and sequentially supplied into the treating channel at the input station, with the different batches being separated by carrier media which hence creates an intermediate mass of bulk elements for a short lengthwise extent of the channel disposed between the trailing end of one batch and the leading end of the next following batch.

The process of the present invention also can be effectively utilized for surface treating parts which are larger and/or longer than the small bulk parts typically utilized with vibratory channels, with such larger and/or longer parts typically being intermixed with carrier media which defines a large number of inert elements for movably supporting the parts during the vibratory moving of the parts during the longitudinal downstream movement of the mass along the channel.

It will be appreciated that the upper extremity of the channel 20 can be suitably closed, as by a cover (not shown) if desired so as to assist in confinement of the blasting spray and hence confinement of the overall flowing mass.

With the above process, it has been experimentally observed that abrasive surface treating of some parts, due to the manner in which all parts are required to flow through the concentrated high-energy abrasive spray zone, can be effectively and properly surface treated within a time period which is much less than required using conventional barrel or basket tumblers, thus providing significantly improved operational efficiencies.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A process for treating the surfaces of flowable solid parts, comprising the steps of:

providing a tublike vibrator device having therein a generally horizontally-elongated treating channel which is of narrow width and which extends angularly about a center point;

providing a flowable mass of solid elements with at least a quantity of said elements comprising individual flowable solid parts;

supplying said flowable mass into said channel so that the mass, over a length of the channel, fills the channel to a significant depth which is less than the maximum channel depth;

vibrating the tublike device to cause the mass of solid elements, when supplied to the channel, to flow lengthwise of the channel while undergoing a corkscrew-like motion wherein the elements undergo a gentle rotatable tumbling movement through numerous closely-adjacent transverse convolutions with the forward advance per convolution as the mass slowly moves lengthwise along the channel being less than the width of the channel;

providing a spray arrangement positioned adjacent the channel so that a discharge orifice thereof is positioned closely adjacent and above the flowing mass and is oriented generally downwardly toward the flowing mass as it advances slowly along the channel with said corkscrew-like motion;

discharging from said orifice an abrasive spray comprising a high-velocity fluid carrier having small abrasive particles entrained therein and directed generally downwardly into the flowing mass to define a concentrated spray zone which contacts a small concentrated surface area of the upper surface of the flowing mass and which penetrates a substantial distance downwardly into the flowing mass to effect treating of multiple surfaces of the parts as they slowly tumble during their passage through the spray zone during the corkscrew-like movement of the flowing mass, the abrasive spray contacting the surface area of the flowing mass over a majority of the width of the channel and over a lengthwise extent which equals or slightly exceeds the lengthwise forward advance defined by adjacent transverse convolutions of the flowing mass; and continuing the corkscrew-like motion of the flowing mass downstream away from the spray zone.

2. A process according to claim 1, including positioning the discharge orifice of said spray arrangement substantially at or within a mouth of said channel and spaced upwardly above the flowing mass so that the discharged abrasive spray is confined within the channel and is allowed to diverge sidewardly so that the spray zone, where it contacts the flowing mass, extends across a substantial part of the channel width and extends lengthwise of the channel by a similar amount; and maintaining the abrasive which is sprayed into the mass within the flowing mass for further abrasive contact with the parts as the flowing mass moves lengthwise of the channel away from the spray zone.

3. A process according to claim 2, wherein the channel is defined by bottom and side walls which are joined by rounded corners so that a bottom portion of the channel has a generally rounded configuration and the channel has a relatively narrow width so that the vibration of the tublike device causes the flowing mass to undergo said numerous closely adjacent convolutions as the mass is advanced lengthwise along the channel so that substantially all of the parts are effectively moved upwardly into and through the spray zone during the corkscrew-like movement of the mass.

4. A process according to claim 3, wherein the parts are of a delicate or frangible material and/or have a complex three-dimensional configuration.

5. A process according to claim 1, including the steps of:

providing a second spray arrangement positioned adjacent the channel at a location which is disposed in spaced relationship from the first-mentioned spray arrangement and which is disposed downstream thereof relative to the lengthwise direction of movement of the flowing mass along the channel; and discharging from an orifice associated with said second spray arrangement a surface treating stream which is directed generally downwardly into the flowing mass to define a concentrated spray region which covers a significant part of the width of the upper surface of the flowing mass and which penetrates a substantial distance downwardly into the flowing mass to effect surface treating of the parts as they slowly rotatably tumble during their passage through the spray region during the corkscrew-like movement of the flowing mass, said spray region being located downstream of and spaced from the spray zone defined by said first-mentioned spray arrangement, and the treating stream discharged from said second spray arrangement being different from the abrasive spray discharged from said first-mentioned spray arrangement so as to effect a different surface treatment of the parts as they move through the spray region.

6. A process according to claim 1, including providing the treating channel of the tublike vibrator device with first and second generally annular channel parts which effectively surround one another and are in lengthwise communication with one another to define a path for the flowing mass.

7. A process according to claim 1, wherein the channel has a rounded concave bottom wall, a width in the range of from about four inches to about eight inches, and an arcuate configuration extending through an angle of at least about 360°.

8. A process according to claim 1, wherein the discharging of the abrasive spray into the flowing mass within the channel causes the spray zone where it contacts and penetrates into the mass to extend over a contact distance in the lengthwise direction of the channel which is in the range from about one to about one and one-half times the forward advance defined by the convolutions of the flowing mass so that substantially all parts within the flowing mass move into and through the spray zone during a single passage of the flowing mass along the channel.

9. A process according to claim 1, wherein the horizontally elongate channel has a generally spiral configuration as it extends from the inlet location to the outlet location, and the outlet location is disposed on the spiral radially outwardly of the inlet location.

10. A process according to claim 1, including the step of discharging a second abrasive spray into the flowing mass within the channel at a location spaced downstream from said first-mentioned abrasive spray with said second abrasive spray being defined by high-velocity air containing entrained abrasive particles to define a second spray zone which penetrates into the flowing mass to effect abrading of the parts as they move through the second spray zone.

11. A process according to claim 10, wherein the abrasive particles discharged into the flowing mass at said second spray zone have physical properties which are different from the abrasive particles discharged into said mass at said first-mentioned spray zone to permit different surface treating of the parts as they sequentially move through the first-mentioned and second spray zones.

12. A process according to claim 11, wherein each of the first-mentioned and second abrasive sprays are discharged at locations disposed closely adjacent but above the flowing mass so as to be discharged downwardly onto and into the flowing mass as it moves lengthwise along the channel.

13. A process according to claim 12, including effecting separating of a significant quantity of said abrasive particles as supplied at said first-mentioned spray zone from said mass and discharging said separated abrasive particles from said channel at a location which is disposed downstream of said first-mentioned spray zone but upstream of said second spray zone.

14. A process for abrading flowable bulk parts, comprising:

providing a vibratory treating device defining therein a horizontally elongated, upwardly opening treating channel having a width which is small relative to the channel length;

supplying a flowable bulk mass containing a large quantity of bulk parts into said channel at a supply location so as to fill the channel to a depth less than the maximum channel depth;

providing said flowing bulk mass with bulk insert tumbling elements mixed with said bulk parts to provide for carrying and spacing of the bulk parts as they are tumbled along the channel, the inert tumbling elements having a shape which is different from the shape of the bulk parts;

vibrating the treating device so that the bulk mass flows lengthwise of the channel while undergoing a gentle continuous movement along a generally helical flow path which extends lengthwise of the channel away from the supply location and has numerous closely-adjacent transverse convolutions so that the individual bulk parts are gently rotatably tumbled in a generally transverse circular path and are simultaneously advanced lengthwise of the channel;

providing a first discharge nozzle having a discharge orifice positioned closely adjacent and above and downwardly directed toward the helically flowing mass within the interior of said treating channel at a location between said supply location and a discharge location for said parts;

discharging from the orifice of said discharge nozzle a downwardly directed abrasive spray defined by high-velocity air containing entrained abrasive particles to define a first spray zone which penetrates into the helically flowing mass over a substantial width and depth thereof and which contacts the helically flowing mass over a lengthwise extent which at least equals the forward advance per convolution thereof to effect abrading of the parts as they move through the spray zone due to the gentle rotatable tumbling of the parts transversely of the channel and the simultaneous lengthwise advancement thereof;

providing a second discharge nozzle having a discharge opening position closely adjacent and above and directed downwardly toward the helically flowing mass within the interior of said treating channel at a location which is spaced downstream from said first discharge nozzle in a direction of flow of the flowing mass along the channel;

discharging from the orifice of said second discharge nozzle into the continuous tumbling mass an abrasive spray defined by a high-velocity carrier fluid having entrained abrasive particles to define a second spray zone which penetrates into said helically flowing mass downstream from said first spray zone to effect further treating of the parts as they move through the second spray zone due to the vibratory helical tumbling movement thereof, the abrasive spray discharged from said second discharge nozzle having physical properties which are different from the abrasive spray discharged from said first discharge nozzle;

the helical vibratory movement of the tumbling bulk mass along the channel causing and allowing the orientation of the individual bulk parts within the helically flowing mass to constantly change as the parts slowly move through the first and second spray zones so that different surfaces and edges of the parts are subjected to the high-velocity abrasive sprays which, in combination with the gentle tumbling contact of the parts with one another, effect surface treating of the parts;

discharging the flowable bulk mass from the treating channel at said discharge location which is disposed downstream from said second spray zone; and continuing the vibration of the treating device to continue the gentle helical flow of the bulk mass from the supply location into, through and then downstream away from the first spray zone and thence into, through and downstream away from said second spray zone and thence downstream for discharge of the bulk mass at said discharge location so that the bulk mass is subjected to a first-in first-out treating operation.

15. A process according to claim 14, including the steps of:

maintaining the abrasive which is sprayed into the flowing mass at said first spray zone within the flowing mass for further abrasive contact with the bulk parts as the flowing mass moves lengthwise of the channel downstream away from said first spray zone.

16. A process according to claim 15, including effecting separation of a significant quantity of said abrasive particles as supplied at said first spray zone from the flowing mass and discharging said separated abrasive particles from said channel at a location which is disposed downstream of said first spray zone but upstream of said second spray zone.

17. A process according to claim 14, wherein the air as discharged by said first discharge nozzle has a discharge velocity in the range of between about 80 feet per second and about 150 feet per second.

18. A process according to claim 14, wherein the treating channel has first and second generally annular channel parts which surround one another and which provide communication from a downstream end of one channel part into an upstream end of the other channel part so that the flowing bulk mass can move continuously along the length of the channel from the supply location to the discharge location.

* * * * *